US007026950B2

(12) United States Patent
Guggari et al.

(10) Patent No.: US 7,026,950 B2
(45) Date of Patent: Apr. 11, 2006

(54) MOTOR PULSE CONTROLLER

(75) Inventors: Mallappa I. Guggari, Cedar Park, TX (US); Keith Womer, Round Rock, TX (US)

(73) Assignee: Varco I/P, Inc., Houston, TX (US)

( * ) Notice: Subject to any disclaimer, the term of this patent is extended or adjusted under 35 U.S.C. 154(b) by 146 days.

(21) Appl. No.: 10/789,845

(22) Filed: Feb. 27, 2004

(65) Prior Publication Data

US 2004/0217879 A1 Nov. 4, 2004

Related U.S. Application Data

(60) Provisional application No. 60/499,240, filed on Aug. 29, 2003, provisional application No. 60/454,066, filed on Mar. 12, 2003.

(51) Int. Cl.
*G01V 3/00* (2006.01)

(52) U.S. Cl. ..... 340/853.3; 175/42; 166/250.15

(58) Field of Classification Search ..... 340/853.3; 367/83; 175/42, 48; 166/250.12, 250.15
See application file for complete search history.

(56) References Cited

U.S. PATENT DOCUMENTS

| | | | | |
|---|---|---|---|---|
| 2,005,889 | A | 6/1935 | Dillon et al. | |
| 3,324,717 | A | 6/1967 | Brooks et al. | 73/152 |
| 3,362,487 | A | 1/1968 | Lindsey | |
| 3,385,376 | A | 5/1968 | Hobhouse | |
| 3,517,553 | A | 6/1970 | Williams et al. | |
| 3,541,854 | A | 11/1970 | Jones et al. | 73/228 |
| 3,605,919 | A | 9/1971 | Bromell et al. | 175/27 |
| 3,613,806 | A | 10/1971 | Malott | 175/48 |
| 3,746,102 | A | 7/1973 | Griffin, III et al. | 173/4 |
| 3,827,511 | A | 8/1974 | Jones | 175/25 |
| 3,889,959 | A | 6/1975 | Persson | 277/27 |
| 4,138,669 | A | 2/1979 | Edison et al. | 340/147 R |
| 4,195,699 | A | 4/1980 | Rogers et al. | 175/27 |
| 4,434,971 | A | 3/1984 | Cordrey | 254/273 |
| 4,491,186 | A | 1/1985 | Alder | 175/26 |
| 4,570,480 | A | 2/1986 | Fontenot et al. | 73/155 |
| 4,595,343 | A | 6/1986 | Thompson et al. | 417/53 |
| 4,662,608 | A | 5/1987 | Ball | 254/273 |
| 4,807,469 | A | 2/1989 | Hall | 73/155 |
| 4,854,397 | A | 8/1989 | Warren et al. | 175/26 |

(Continued)

OTHER PUBLICATIONS

Int'l Search Report: PCT/US04/07620: 3 pp.: Mar. 18, 2005.

(Continued)

*Primary Examiner*—Timothy Edwards, Jr.
(74) *Attorney, Agent, or Firm*—Guy McClung

(57) ABSTRACT

The present invention provides a method and apparatus for generating one or more than one physically detectable physical influence changes to control or manipulate a down hole device. The present invention intercepts existing control signals to various controllers on the rig and superimposes an encoded command on these existing control signals. The controllers comprise of motor drives, choke controllers, acoustic pulse generators, tracer injectors and other controllers that are used to generate a physically detectable changes in the rig environment. The encoded command acting on existing or new controllers generates a perceptible change in a physical parameter such as a variation in drilling mud pressure, a variation in drill string rotation speed, a variation is weight on bit, generation of acoustic pulse, or a variation in tracer injection properties. The physical change is sensed by a down hole device and interpreted as information indicating to the down hole device that it is to execute a command or adjust an operating parameter.

20 Claims, 7 Drawing Sheets

U.S. PATENT DOCUMENTS

| | | | | |
|---|---|---|---|---|
| 4,867,254 | A | 9/1989 | Gavignet | 175/48 |
| 4,875,530 | A | 10/1989 | Frink et al. | 175/27 |
| 5,010,765 | A | 4/1991 | Duckworth et al. | 73/153 |
| 5,070,949 | A | 12/1991 | Gavignet | 175/48 |
| 5,311,952 | A | 5/1994 | Eddison et al. | 175/61 |
| 5,342,020 | A | 8/1994 | Stone | 254/269 |
| 5,678,643 | A | 10/1997 | Robbins et al. | 175/45 |
| 5,704,436 | A | 1/1998 | Smith et al. | 175/27 |
| 5,709,285 | A | 1/1998 | Sokalski et al. | 188/106 F |
| 5,813,480 | A | 9/1998 | Zaleski, Jr. et al. | 175/40 |
| 5,826,654 | A | 10/1998 | Adnan et al. | 166/250.01 |
| 5,842,149 | A | 11/1998 | Harrell et al. | 702/9 |
| 5,873,420 | A | 2/1999 | Gearhart | 175/25 |
| 6,016,878 | A | 1/2000 | Jansson | 175/27 |
| 6,026,912 | A | 2/2000 | King et al. | 175/27 |
| 6,029,951 | A | 2/2000 | Guggari | 254/269 |
| 6,059,050 | A | 5/2000 | Gray | 175/73 |
| 6,105,690 | A | 8/2000 | Biglin, Jr. et al. | 175/48 |
| 6,109,367 | A | 8/2000 | Bischel et al. | 175/24 |
| 6,155,357 | A | 12/2000 | King et al. | 175/27 |
| 6,176,323 | B1 | 1/2001 | Weirich et al. | 175/40 |
| 6,186,248 | B1 | 2/2001 | Silay et al. | 175/27 |
| 6,192,998 | B1 | 2/2001 | Pinckard | 175/27 |
| 6,209,662 | B1 | 4/2001 | Stahl | 175/27 |
| 6,233,498 | B1 | 5/2001 | King et al. | 700/174 |
| 6,233,524 | B1 | 5/2001 | Harrell et al. | 702/9 |
| 6,241,462 | B1 | 6/2001 | Wannasuphoprasit et al. | 414/800 |
| 6,272,434 | B1 | 8/2001 | Wisler et al. | 702/9 |
| 6,293,356 | B1 | 9/2001 | King et al. | 175/27 |
| 6,308,787 | B1 | 10/2001 | Alft | 175/48 |
| 6,369,339 | B1 | 4/2002 | Noord | 177/147 |
| 6,374,925 | B1 | 4/2002 | Elkins et al. | 175/25 |
| 6,382,331 | B1 | 5/2002 | Pinckard | 175/27 |
| 6,397,946 | B1 | 6/2002 | Vail, III | 166/250.01 |
| 6,470,976 | B1 | 10/2002 | Alft et al. | 175/61 |
| 6,484,816 | B1 | 11/2002 | Koederitz | 175/25 |
| 6,516,898 | B1 | 2/2003 | Krueger | 175/50 |
| 6,581,455 | B1 | 6/2003 | Berger et al. | 73/152.55 |
| 6,612,382 | B1 | 9/2003 | King | 175/40 |
| 6,626,251 | B1 | 9/2003 | Sullivan et al. | 175/40 |
| 6,629,572 | B1 | 10/2003 | Womer et al. | 175/219 |
| 6,637,522 | B1 | 10/2003 | Wilson et al. | 175/25 |
| 6,769,497 | B1 | 8/2004 | Dubinsky et al. | 175/27 |
| 6,787,758 | B1 | 9/2004 | Tubel et al. | 250/227.14 |
| 2004/0124009 | A1 | 7/2004 | Hoteit et al. | 175/25 |
| 2004/0124012 | A1 | 7/2004 | Dunlop et al. | 175/57 |

OTHER PUBLICATIONS

Written Opinion of Int'l Searching Authority: PCT/US04/07620: 3 pp.: Mar. 18, 2005.

MOTOR PULSE CONTROLLER

CROSS REFERENCE TO RELATED APPLICATIONS

This patent application is related to and takes priority from U.S. Provisional Patent Application No. 60/454,066 filed on Mar. 12, 2003 entitled "A Motor Pulse Controller" by Mallappa Guggari and Keith Womer and U.S. Provisional Application No. 60/499,240 filed on Aug. 29, 2003 entitled "A Motor Pulse Controller" by Mallappa Guggari and Keith Womer.

BACKGROUND OF THE INVENTION

1. Field of the Invention

The present invention relates generally to the field of surface to down hole communication techniques for an oil rig. The invention pertains in particular to a direct interface which intercepts existing commands going to existing oil rig equipment and superimposing additional commands onto the existing commands to manipulate drilling mud pressure and/or other physically perceptible influences which a down hole tool or other device can detect and interpret.

2. Background of the Related Art

Varying mud pressure to command a down hole tool is well known in the art. Currently known techniques for manipulating mud pressure to communicate a command from the surface to down hole equipment are inefficient. These known mud pressure command systems require large, heavy equipment to be added to the oil rig to manipulate mud pressure. One example of a known mud pressure command system is the Halliburton Geo-Span™ downlink system. The Geo-Span™ system diverts mud flow to reduce mud pressure to change the azimuth and inclination of a steerable drilling system. The Geo-Span™ system requires the addition of a bulky high pressure mud diversion valve and controller. Such an addition is expensive and requires the utilization of additional rig space which is at a premium. Thus, there is a need for a down hole communication system that does not require the addition of the bulky mud diversion valve to existing equipment.

Some systems require operator to manually switch the mud pump on and off to create a pressure fluctuation. This pressure fluctuation is used to signal or command a down hole device which senses a change in the mud pressure. This manual technique is slow (on the order of several minutes to transmit a simple command). Moreover, these manual commands are subject to error due to the variation between operators' implementations of the manual commands. Thus, there is a need for a faster and more precise communication method and apparatus for communicating with down hole equipment.

SUMMARY OF THE INVENTION

The present invention provides a method and apparatus for communicating control commands from an oil rig surface location to a down hole device. The control commands comprise one or more than one physically detectable changes which are sensed by the down hole device. When using more than one physically detectable changes, the physical changes can occur simultaneously or sequentially. The present invention performs specific causal acts by intercepting existing control signals and superimposing one or more commands on top of the existing control signals. The superimposed command causes physical changes, such as a variation in mud pump pressure and/or rotation that can be sensed by a down hole tool or a device.

Additionally, the superimposed wave form or command may cause a variation in drill string rotation speed, addition of a tracer to the drilling mud or transmission of an acoustic pulse down hole. The superimposed command may also manipulate a draw works to vary the weight on bit, or vary the speed of a mud pump to change drilling mud pressure, or manipulate a top drive to change rotation speed. The physical change (e.g., a change in rotation, mud pressure, tracer presence, or an acoustic pulse) is sensed by a down hole device. The down hole device interprets the physical change as a command to the down hole device that it is to perform an operation such as adjusting an operating parameter such as a drilling angle.

DETAILED DESCRIPTION OF AN EMBODIMENT OF THE INVENTION

Figure 1:
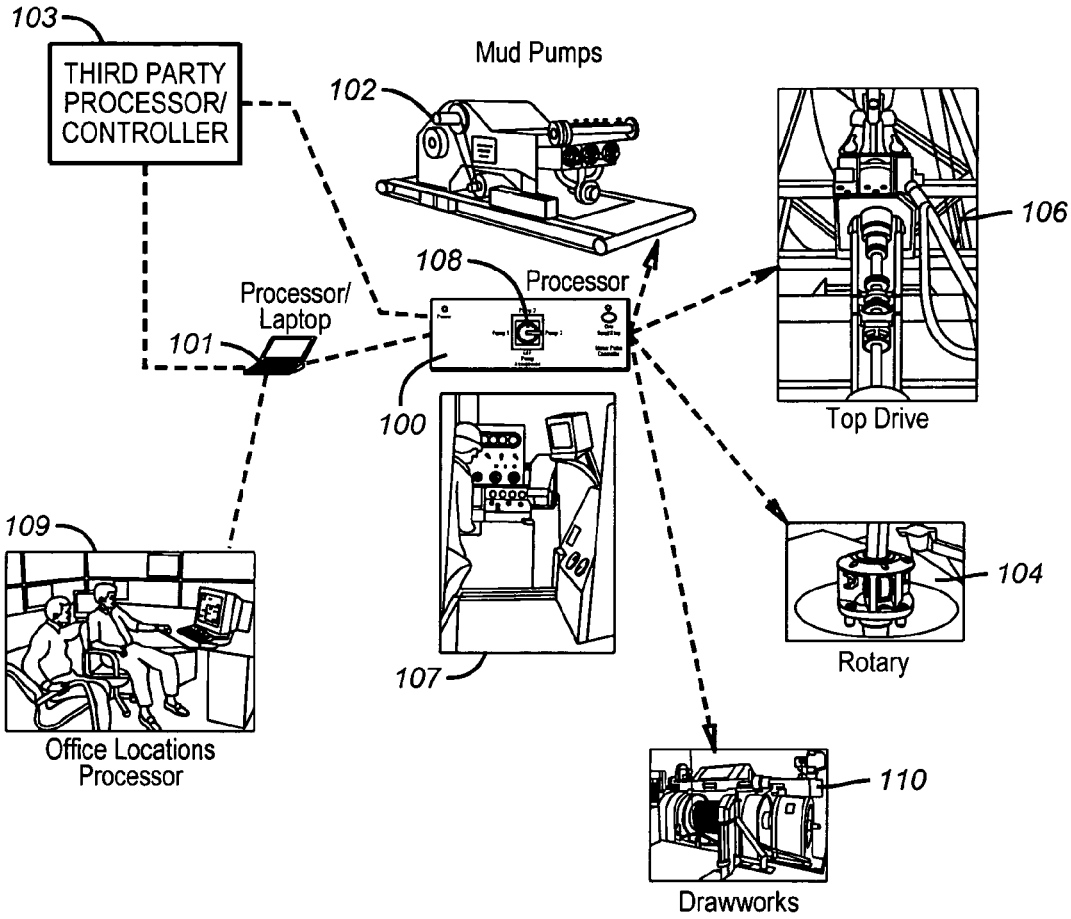
FIG. 1 is an illustration of a preferred embodiment of the present invention in communication with a remote location, lap top computer, mud pump, top drive, draw works and rotary.

The present invention provides a simple controller to command existing equipment to cause physically perceptible changes in the down hole environment. A down hole tool or a device detects the physical changes and interprets them as a command. The command causes the down hole tool or a device to perform an act such as changing the drilling angle. The present invention interfaces with existing oil rig equipment without the need to add a bulky mud diversion valve to change mud pressure. The present invention eliminates the need to perform manual manipulation of the existing oil rig equipment to command a down hole tool.

The present invention superimposes commands on a selected SCR controller or other equipment to generate predefined changes in a motor speed or another equipment's output which causes a change in mud pressure or some other physical change which can be detected at down hole. In one example, the present invention generates variations in mud pressure or in the flow rate of the drilling mud by changing commands sent to a SCR controller. The SCR controller then manipulates mud pressure by changing the mud pump speed. The present invention can also generate variations in mud pressure by changing commands sent to a controllable choke. The present invention can also generate rotational speed variation commands in top drives or rotaries to generate a perceptible variation in the rotation speed of the drilling mechanism. The present invention is also used to generate a variation in the weight on bit or speed of hoisting and lowering via manipulation of a draw works. The present invention can also inject tracers which can be electronic or doped chemically or with nuclear isotopes. The present invention enables drillers or other users to send predetermined sequences or combinations of physical influences which are detected and interpreted as commands by a down hole tool or a device. These predetermined commands can be one shot, multiple shots or continuous or periodic bursts of physically perceptible changes.

In one example of the present invention, a controller is designed around and incorporates an industry standard embedded controller to provide a reliable and familiar operation. The controller is packaged in a rugged housing to meet the rigorous specifications for industrial oilrig site usage. In the present example of the invention, a small easily installed lightweight controller is provided with an intuitive user interface. A user interface is provided to enable a user to easily command down hole operations, such as drilling angle or data reporting rate by manipulation of a physically perceptible physical parameter.

In the present example of the invention, a controller is provided which is designed to interface seamlessly with all major silicon controlled rectifier (SCR) drives as well as the alternating current (AC) drives. In the current example of the invention, the controller provides operational flexibility. In a preferred embodiment, the present invention provides a controller designed to provide a communication interface with three SCR drive systems at a time. Utilizing the present invention, a rig operator or other user can easily communicate with the controller to superimpose command data upon existing rig control signals. The superimposed data is used to send command data to down hole tools or devices by manipulating the rig equipment to effectuate a perceptible physical parameter in the operational state of the rig. The user can define the data using graphical interface tools provided by the user interface of the present invention to avoid costly mistakes from human error induced variances in manual operation. The present invention enables product and service providers to focus on maximizing reliability by providing a familiar interface that can be bypassed at will. The present invention offers additional combinations of physical influences for generating commands.

As shown in FIG. 1, in the current example of the invention, a motor pulse controller 100 of the present invention interfaces with three independent SCR drive systems associated with an oil rig. In the present embodiment, each single motor pulse controller 100 interfaces with three SCR drive systems or controllers. Additional motor pulse controllers 100 are combined with the motor pulse controller 100 to provide an interface with additional SCR drive systems/controllers. These SCR drive systems/controllers control rig devices, such as a mud pump 102, a rotary table 104, a draw works 110, a top drive 106 or another equipment controller associated with the oil rig. In the current example of the invention, a controller 100 sends command signals through one of the SCR drives to change mud pressure, rotation speed or weight on bit. These changes cause a perceptible change in a physical parameter that can be sensed down hole. Commands are initiated by a user or an automated source 103. The user can send commands from a remote location 109 or through a local controller such as a lap top computer 101. The selection of the SCR drive to use can be easily selected by a switch 108 located on the front plate of the unit located on the rig control floor 107. Switch 108 is shown in more detail in FIG. 2. The user or driller can completely bypass this unit by placing switch 108 in "off" position.

Figure 2:
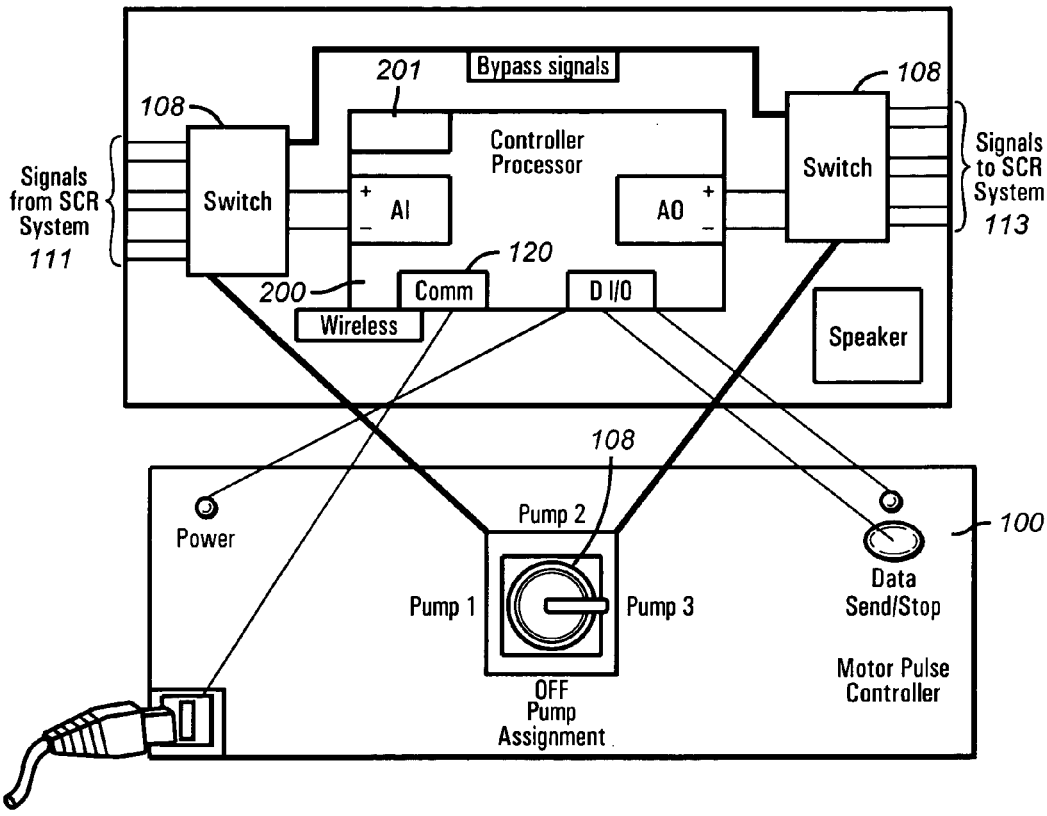
FIG. 2 is an illustration of a preferred controller.
Figure 3:
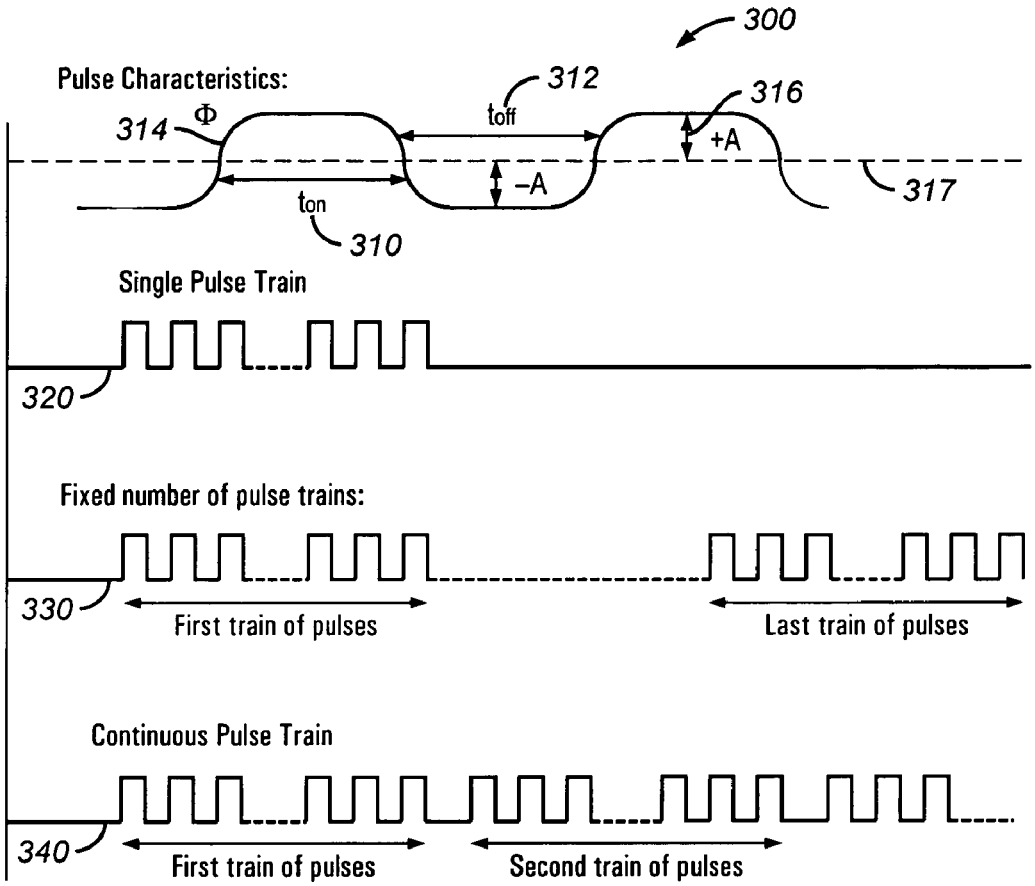
FIG. 3 is an illustration of a variety of pulse and pulse string characteristics, which are configurable via a graphical interface or by a command on a laptop computer or from a remote location.

As shown in FIG. 2, in the current example of the present invention, a processor 200 is remotely commanded by a user or an automated source via communication port 120. The user commands causes the processor 200 to send encoded pulses (as shown in FIG. 3) or predefined offsets superimposed on top of the existing control signals 111 which are sent to the selected motor controller. The user commands manipulate and create a variation in the SCR motor control outputs. In the current example of the invention, a PC-based user-friendly graphical interface program translates the user inputs into controller commands. The user need only enter a simple graphical command via the user interface 618 shown in FIG. 6. The user need not manipulate or specify actual motor pulse waveforms from user interface 618 at remote location 109, lap top 101 or rig floor 107 as this is performed by processor 200 of the present invention. That is, the present invention takes the user's simple graphical or textual input from user interface 618 and generates an appropriate controller command for the designated equipment. The present invention can also take commands from automated sources like dynamic models or third party controllers at interface 618. The command can augment a SCR motor control signal or another control signal motor control to effectuate the user's designated command. A user can easily modify the command data via the user interface 618 and send that command data to the processor 200 using TCP/IP Ethernet link 120. Use of TCP/IP link 120 allows various other types of devices like embedded controllers or PDAs or another wireless device to send command data directly to this processor 200.

Existing SCR signals 111, from the existing conventional driller console on the oil rig floor 107 enter switch 108 through input terminals 111 and exit switch 108 at output terminals 113 as signals to an SCR system or another controller. Depending on the state of the switch 108, the existing SCR signals 111 either bypass processor 200 or pass through processor 200. Processor 200 superimposes commands on a selected existing SCR signal 111 when switch 108 is in an "on" position 1,2 or 3. Control signals 111 are also commands to SCR controllers or other controller rather than an SCR controller to vary rotation speed, add a tracer, vary weight on bit or initiate an acoustic signal which are initiated from user interface 618. Additional commands can be generated from user interface 618 to accommodate new drivers or equipment to be added to the oil rig system.

Turning now to FIG. 3, an example of command 300 which is superimposed on an existing command 317 is shown. The shape of a command pulse train can be defined by specifying pulse duration (T-on 310 and T-off 312) and amplitude 316. In a preferred embodiment, the user designates a particular command at the user interface 618. The processor of the present invention receives a user input and specifies the pulse shape, periodicity and duration to effectuate the desired command. The present invention takes the user input from the user interface specifies the corresponding pulse duration by configuring the pulse shape, periodicity, duration, turn on and turn off times for each command pulse. The command pulse rise and fall time response 314 (Φ), that is, the rise/fall time of each pulse can be configured as a predefined wave shape, e.g., similar to a portion of a sine wave. The present invention can also limit the modifications to existing command based on preset conditions or dynamic state of the equipment or operational limits imposed by third party sources. In the present example, the processor defines the frequency component of this sine wave as an input based on user input and predefined equipment commands. The pulse amplitude 316 (A) is also configurable to designate particular equipment commands. In the present example, the user defines the amplitude of the pulse by providing a text or graphical command which the present invention interprets and calculates the corresponding command amplitude A. The controller generates pulses of magnitude A above or below the current value of the motor output 317 based on configuration of oil rig equipment to be controlled and the command specified by the user at user interface 618. In the present example of the invention, the controller 200 also generates pulses with current value 317 minus A as minimum level and/or current value plus A as a maximum level.

As shown in FIG. 3, in the present example, various command pulse modes are supported. Essentially any desired pulse string modification mode is supported, however, the present example illustrates three modes for example. The first command mode is the Single Pulse Train Mode 320. In Single Pulse Train Mode, when a user pushes the send/stop button, a single set of pre-defined pulses is sent only once. In the Fixed Set Of Pulse Train Mode 330, when the user pushes the send/stop button, pre-defined sets of pulses are sent at defined intervals for a fixed number of times. The processor 200 defines the repeat interval as well as the number of iterations of the signal. In the Continuous Pulse Train 340 mode, when a user pushes a send/stop button, a pre-defined set of pulses is sent at defined intervals continuously until send/stop button is pressed again.

Figure 4:
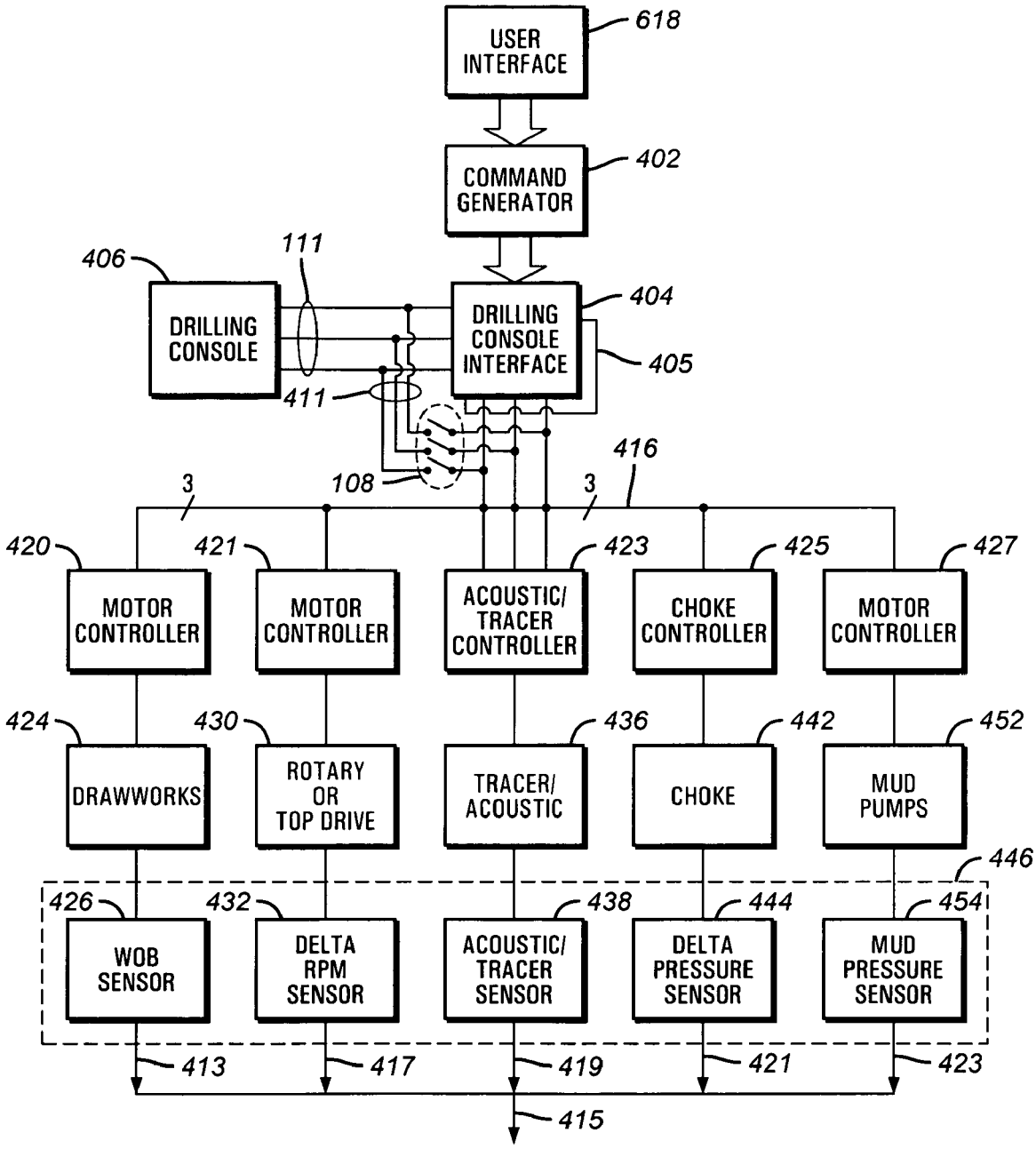
FIG. 4 is an illustration of a preferred embodiment of the present invention showing a system for generating commands to down hole equipment.

Turning now to FIG. 4 a system for generating commands to down hole equipment is illustrated. A user inputs a command chosen from a pull down menu on user interface 618. The command is shown on user interface 618 as a human readable instruction such as, "steer down 30 degrees during drilling." The human readable instruction may also be an icon indicative of the desired command. The command may also come from automatic source like dynamic modeling or third party controller. In the present example, an operator selects a steer command and selects the orientation and degree of change in orientation, such as down/up, 0–90 degrees. The user interface 618 sends the user command to the command generator 402 which resides in processor 200. The command generator is detailed in FIG. 5 and discussed below.

The command generator translates the user input command to an equipment command based on the system state. The command generator 402 sends the equipment command it generated, to the drilling console interface 404. The drilling console interface 404 superimposes the user command on existing signals 111 coming from drilling console 406. The equipment command comprises, for example, a stream of control pulses discussed above for signaling the controllers 420, 421, 423, 425 and 427 to implement a change in rotation, mud pressure, weight on bit or tracer concentration.

As shown in FIG. 4, the compact drilling console interface 404 is easily installed between existing drilling console 406 on the drill rig floor 107 and controllers 420, 421, 423, 425 and 427. Thus, the present invention is easily retrofitted in the field without extensive modification to existing oil field equipment. The present invention provides additional lines 411 which are spliced onto communication lines 111 running to and from existing drilling controller 406. Switches 108 divert incoming signal 111 to bypass the drilling console interface 404 when closed. The incoming signals 111 are sent through drilling console interface 404 when switch 108 is open. In a preferred embodiment only one of three inputs 111 are sent through controller 404 at a time. A single drilling console interface 404 preferably handles three sets of inputs 410. Thus, one or more additional drill console interfaces 405 can be added for handling additional sets of inputs 111.

Controllers 420, 421, 423, 425 and 427 receive equipment commands from command generator 402, interpret the equipment command and issue an equipment specific command to control a down hole device accordingly. As shown in FIG. 4, as an example, a motor controller 420 is commanded to manipulate a device, such as a draw works 424. The draw works 424 changes weight on bit. This change in weight on bit is sensed by a down hole weight on bit sensor 426. Similarly, motor controller 421 commands RPM generator 430 such as a top drive or rotary. The command changes the rotation rate, which is sensed by a down hole rpm sensor 432.

Acoustic/Tracer controller 423 commands a tracer injection or generation of an acoustic signal via tracer/acoustic system 436, well known in the art, into the mud supply. The tracer comprises a traceable fluid such as detectable by a down hole tracer/acoustic detector 438. The tracer may also comprise injection and removal of micro spheres, which can be detected by a down hole tracer/acoustic detector 438. The injection and removal of such micro spheres is well known in the art for the purpose of changing the density of drilling mud. The inventors, however, are aware of no application in which micro spheres have been used as a command generator, either alone or in combination with another command such as a change in mud pressure or drill string rotation speed. The micro sphere tracer or acoustic signal is preferably detectable by a down hole tracer/acoustic detector 438 by detecting a change in density or by sensing a physical characteristic such as an electrical characteristic unique to the tracer spheres. The micro sphere tracer can also contain electronic components capable of sensing, storing or transmitting data which can be detected by a down hole device.

Choke controller 425 receives commands and sends commands which control choke 442 for restricting mud flow for modulating the mud pressure for sensing by a down hole pressure detection device 444, well known in the art. Motor controller 427 receives commands and sends commands which control mud pumps 452 for restricting mud flow for modulating the mud pressure for sensing by a down hole mud pressure sensor device 454, well known in the art. Each sensor 426, 432, 438, 444 and 454 can be associated with but separate from down hole equipment. Each sensor 426, 432, 438, 444 and 454 sends a command 413, 417, 419, 421 and 423 to the down hole equipment.

In an alternative embodiment, the down hole sensors 426, 432, 438, 444 and 454 are contained in a central sensor assembly 446 (shown as a dotted line in FIG. 4) which houses sensors 426, 432, 438, 444 and 454 senses changes in weight on bit, rotation, tracers and mud pressure and sends a command 415 to a down hole equipment.

Figure 5:
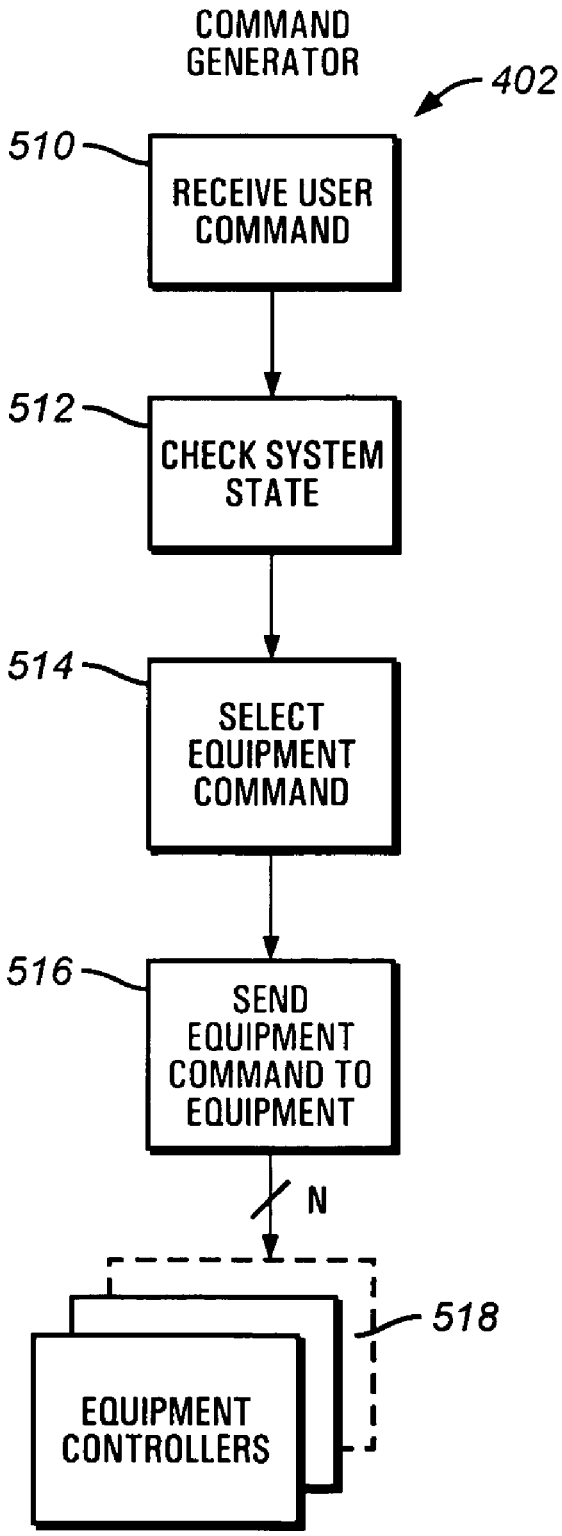
FIG. 5 is an illustration of a command generator, which translates a user input into an equipment command for transmitting to a down hole equipment.

Turning now to FIG. 5, the command generator which runs as a process in processor 200 is shown in schematic form. As shown in FIG. 5, the command generator translates a user input into an equipment command for transmitting to a down hole equipment. The command generator 402 receives a user command 510 from the user interface 618. The command generator checks the system state 512 to determine which equipment is running and actually connected to the system. A current system operational state subsumed in the system state comprises, for example, current bit weight, current mud pressure, current tracer concentration and current tracer type present and current operational (on/off/offline) state for equipment in the system.

The command generator selects a command based on the system state stored in the processor memory 201. For example, if an equipment for causing a change in rotation, an equipment for causing a change in mud pressure, an equipment for causing a change in bit weight, an equipment for sending an acoustic pulse down hole and an equipment for changing tracer presence are all available in the system state, then a command using all of these available physical parameters can be sent down hole. The command sensed by the down hole device can be a combination of all available physical influences perceptible down hole. If only a subset of equipment is available to cause changes in physical parameters, then the commands sent down hole comprise only those physical parameters which can be generated by the available equipment.

The command generator generates a command, which comprises one or more physical influences such as for example changes in pressure, weight on bit, tracer concentration, acoustic pulse generation and rotation speed to represent a command detected and, understood by a particular equipment located down hole. Additional physical influences can also be used as commands. The command generator, via the system state knows the type of equipment available, the equipment manufacturer and the type of sensor associated with the down hole equipment. The command generator looks at what physical parameters the down hole device can sense and sends and appropriate equipment command to equipment controllers 518, which correspond to controllers 420, 421, 423, 425 and 427 in FIG. 4.

In the present example there are five primary detectable physical influences (weight on bit variation, drill string rpm variation, variation in the presences or type of acoustic signal or a tracer, and mud pressure variation.). These physical influences are physically perceptible by down hole detectors 413, 417, 419, 421 and 423. Thus there are five primary influences that can be present or not present to represent a total of thirty-two commands or states in which these five primary influences appear. These five primary influences are used to represent thirty-two command states which can be transmitted to and perceived by down hole equipment. Additional physical influences can be added. Thus, if there are M available primary physical influences, some of which may not be known today, there are $2^M-1$ command states or command available which can be derived from M on off state physical influences, when the physical influences are used concurrently. With each of these primary command states there are numerous additional secondary command states represented by perceptible differences within a primary physical influence. For example, within a single primary influence such as rotation speed (rpm), a down hole equipment can be signaled with a different command for each secondary state of a primary influence of 10 rpm, 20 rpm, 30 rpm and 40 rpm. Also, if the M physical influences are performed serially, then numerous additional commands are available according to various sequences of physically perceptible parameters.

Figure 6:
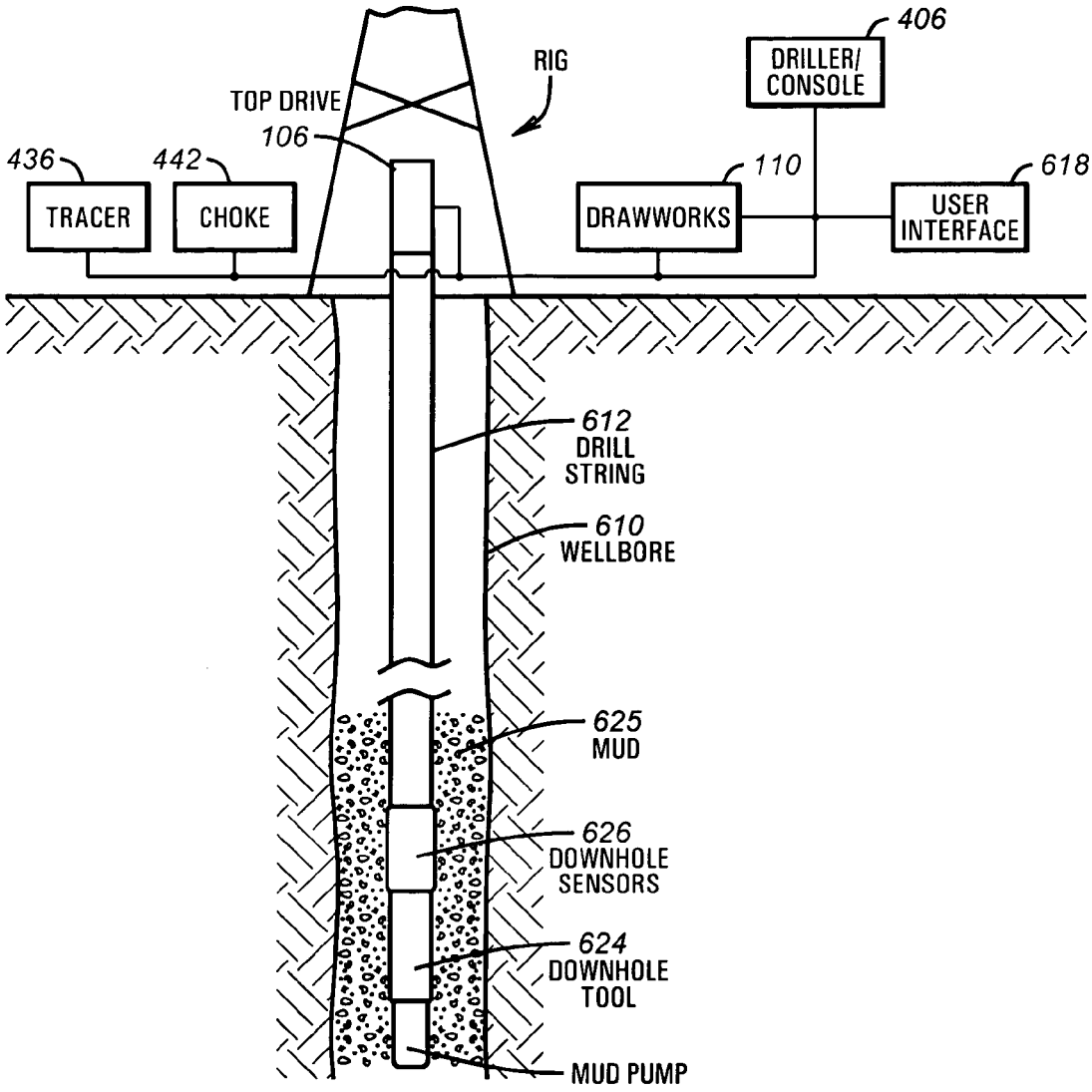
FIG. 6 is an illustration of a system utilizing the present invention to control a down hole device in a drilling rig using a user interface to generate commands.

Turning now to FIG. 6, a preferred embodiment of the present invention is shown with user interface 618, top drive 106, choke 442, driller console 406, tracer and acoustic controller 436 and draw works 110. These elements operate together as described above to send commands through drilling mud 625 and drill string 612 manipulation to down hole sensors 626 which command the down hole device 624.

Figure 7:
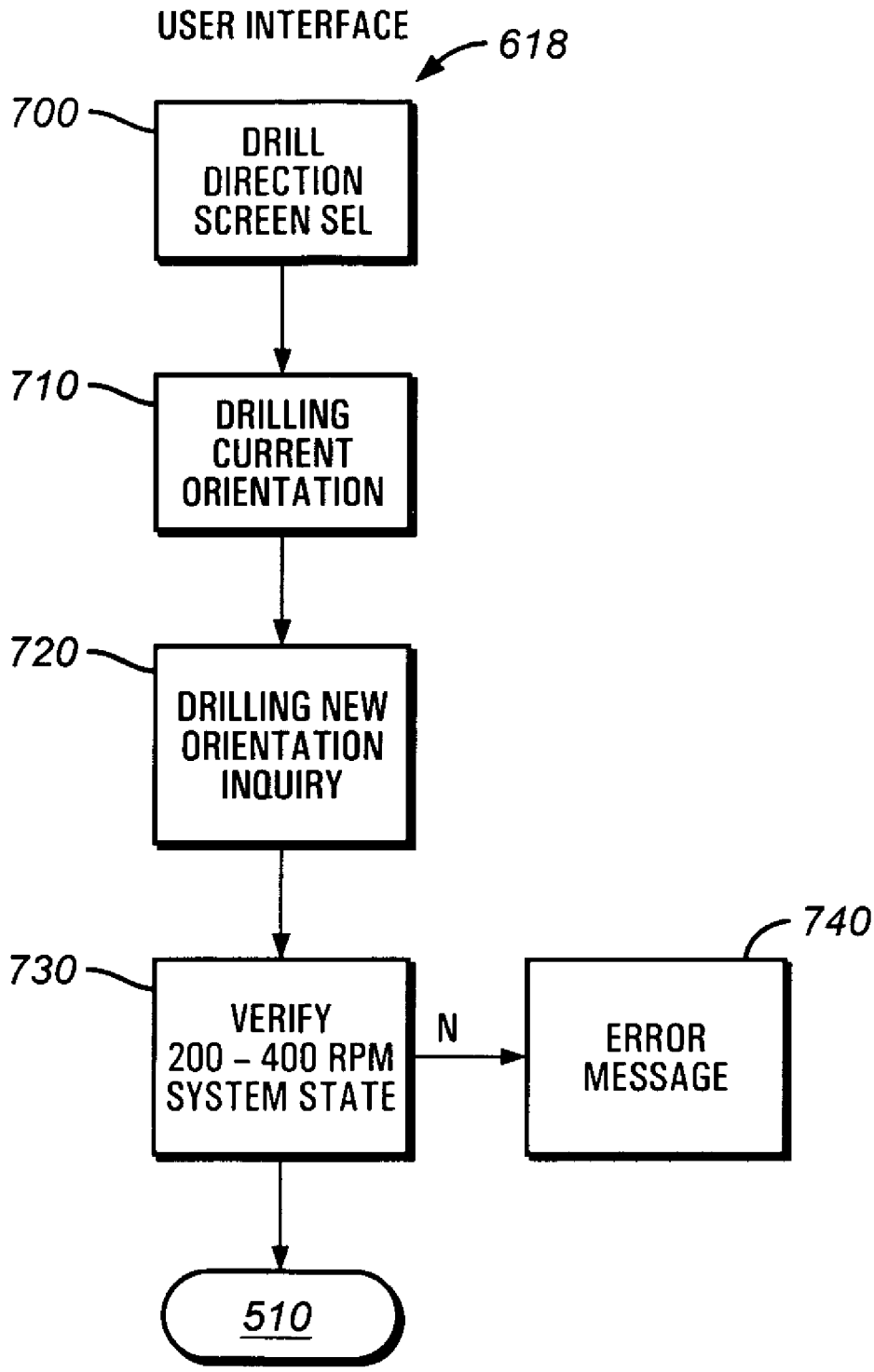
FIG. 7 is an illustration of a input sequence for entering a drilling orientation command.

Turning now to FIG. 7, an illustration of the present invention is shown soliciting a user input from the user interface 618 such as, "select drilling direction." The user input from user interface 618 can be textual, graphical, aural such as a verbal command or a computer generated as in modeling. A drill direction screen 700 is presented to the user who inputs the desired drilling direction. For example, a user can input drill down at a 30-degree angle, at block 700. At block 710 in the current example, the present invention determines the current drilling orientation and the change of direction requested, that is, the change from the current orientation to achieve a new orientation as requested by the user. The present invention then verifies the system state 730 to determine the operational state of the available equipments to ensure that a command is available. For example, if the rpm are already at a maximum, for example, over 400 rpm, then a command requiring an increase in the rpm would not be available and an error message 740 is generated. If the system state is within an appropriate range, then the present invention proceeds to the command generator 510 where the human readable command provided by the user interface 618 is encoded into an equipment command. The equipment command is then superimposed on the existing control signals and sent to the controllers as shown in FIG. 5. The user input and system configuration tasks, some of which are shown in FIG. 7 can be distributed between controllers 100, 101 and 109. A third party controller 103 can also be used to input commands and to dynamically change the operating parameters of the oilrig.

For example, the user interface for a user inputting commands to the system and for a user receiving feed back from the system can be distributed between 100, 101 and 109. The user commands and feed back can be graphical, textual or aural. A user can issue a command, such as change the steering angle of a down hole device by 40 degrees. Another task that can be distributed between the processors 100, 101 and 109 is the collection of system status. System status comprises system configuration and operational states, such as a speed at which a motor is running, how many motors are assigned, what kind of tracer or concentration is being used, what kind of acoustic signal is available, and what kind of top drive is attached to the system. This system status is communicated either directly or indirectly to the user. The direct communication to the user comprises aural, graphical or textual output to the user from 101, 100 and/or 109. Indirect communication to the user comprises notifications that a command cannot be performed because of system states, which inherently includes system state information.

System configuration is distributed between user input processors 100, 101, 109 and also distributed to third party configuration processor 103. Static configuration is normally performed from user input terminal processors 100, 101 and 109, whereas dynamic configuration is usually performed from third party configuration processor console 103. Static configuration is usually performed by setting system parameters such as minimum and maximum rpm rates for all operations states. Dynamic configuration is performed for temporarily setting and usually temporarily changing a system parameter such as minimum and maximum rpm rate for a specific and temporary condition.

For example, a static rpm operating range specified as a minimum and maximum might be set from user input processors 101, 100 or 109. For example a maximum of 400 psi mud pressure is set as a static configuration parameter. Thus a command can be issued that would raise the mud pressure to 300 psi to signal a down hole device. This command is allowed by the processor because the 300 psi does not exceed the maximum mud pressure psi of 400 psi.

A third party at 103 can change the static maximum mud pressure configuration from 400 psi to a dynamic mud pressure maximum of 250 psi. Such a change would override the static maximum and set the mud pressure maximum temporarily to 250 psi. Once the dynamic mud pressure maximum of 250 psi is entered, the command that would raise the mud pressure to 300 psi to signal a down hole device could no longer be performed because it exceeds the dynamic mud pressure maximum of 250 psi. The user would be notified that the requested command cannot be performed. The processor, however, may change the command from a mud pressure command to another physical influence such as tracer, rpm, acoustic or weight on bit in order to perform a command that will accomplish the same thing as the mud pressure command without exceeding the mud pressure maximum. For example, if a steer 40 degrees command can be implemented with a mud pressure pulse of 400 psi or a rpm pulse of 400 rpm, if the mud pressure pulse violates the system maximum, an rpm command would be used to command a steer 40 degrees command.

The present invention has been described as a method and apparatus operating in an oil rig environment in the preferred embodiment, however, the present invention may also be embodied as a set of instructions on a computer readable medium, comprising ROM, RAM, CD ROM, Flash or any other computer readable medium, now known or unknown that when executed cause a computer to implement the method of the present invention. While a preferred embodiment of the invention has been shown by the above invention, it is for purposes of example only and not intended to limit the scope of the invention, which is defined by the following claims.

The invention claimed is:

1. A method for communicating with a down hole device comprising accepting a user input;

creating an equipment command based on the user input;

changing a physical influence comprising one or more primary physical influences associated with the borehole in accordance with the equipment command;

commanding a down hole device based on changing the physical influence;

said commanding comprising intercepting the equipment command and superimposing an additional command on the equipment command to command to the down hole device.

2. The method of claim 1, wherein the physical influence comprises weight on bit.

3. The method of claim 1, wherein the equipment comprises rotation speed.

4. The method of claim 1, wherein the physical influence comprises tracer density.

5. The method of claim 1, wherein the physical influence comprises mud flow rate.

6. The method of claim 1, wherein the physical influence comprises mud pressure.

7. The method of claim 1, wherein the physical influence comprises generating an acoustic signal.

8. The method of claim 1, further comprising: entering user equipment commands in human perceptible form; and translating the user equipment commands into equipment detectable influences.

9. The method of claim 1, further comprising: determining from a system state, available influence command states for generating equipment commands.

10. The method of claim 1, further comprising dynamically changing a system configuration parameter.

11. A computer readable medium containing executable instruction that when executed by a computer perform a method for communicating with a down hole device comprising accepting a user input; creating an equipment command based on the user input;

manipulating a physical influence comprising one or more primary physical influences associated with the borehole in accordance with the equipment command;

commanding a down hole device based on the manipulation in the physical influence;

said commanding comprising intercepting the equipment command and superimposing an additional command on the equipment to command the down hole device.

12. The medium of claim 11, wherein the physical influence comprises weight on bit.

13. The medium of claim 11, wherein the equipment comprises rotation speed.

14. The medium of claim 11, wherein the physical influence comprises tracer density.

15. The medium of claim 11, wherein the physical influence comprises mud pressure.

16. The medium of claim 11, wherein the physical influence comprises mud flow rate.

17. The medium of claim 11 wherein the physical influence comprises generating an acoustic signal.

18. The medium of claim 11, further comprising entering user equipment commands inhuman perceptible form; and translating the user equipment commands into equipment detectable influences.

19. The medium of claim 11, further comprising determining from a system state, available influence command states for generating equipment commands.

20. The medium of claim 11, farther comprising dynamically changing a system configuration parameter.

* * * * *